US007386924B2

(12) United States Patent
Muth et al.

(10) Patent No.: US 7,386,924 B2
(45) Date of Patent: Jun. 17, 2008

(54) PERFORATION DEVICE

(75) Inventors: Mathias Muth, Wiesbaden (DE); Axel Richter, Edemissen (DE); Ralf Sodemann, Peine (DE)

(73) Assignee: Fiberweb Corovin GmbH (DE)

( * ) Notice: Subject to any disclaimer, the term of this patent is extended or adjusted under 35 U.S.C. 154(b) by 0 days.

(21) Appl. No.: 11/673,170

(22) Filed: Feb. 9, 2007

(65) Prior Publication Data

US 2007/0124902 A1 Jun. 7, 2007

Related U.S. Application Data

(63) Continuation of application No. 11/036,513, filed on Jan. 14, 2005, now Pat. No. 7,192,392, which is a continuation of application No. PCT/EP03/07216, filed on Jul. 5, 2003.

(30) Foreign Application Priority Data

Jul. 16, 2002 (DE) ..... 102 32 147

(51) Int. Cl.
*B26F 1/24* (2006.01)

(52) U.S. Cl. ..... 28/106; 83/660

(58) Field of Classification Search ..... 28/106, 28/107, 114, 115, 165, 170; 26/7; 83/331, 83/339, 343, 345, 346, 347, 30, 660; 264/156; 492/28, 30, 31, 33, 36, 37; 425/290, DIG. 37; 493/63, 64, 60, 228; 156/252, 510
See application file for complete search history.

(56) References Cited

U.S. PATENT DOCUMENTS 2,542,298 A 2/1951 Zinn, Jr.
2,748,863 A * 6/1956 Benton ..... 83/345
2,762,433 A * 9/1956 Russell ..... 83/326
3,014,263 A * 12/1961 Oace ..... 28/106
3,137,893 A * 6/1964 Gelpke ..... 28/106
3,307,961 A 3/1967 Stiehl et al.
3,325,868 A * 6/1967 Kalwaites ..... 28/106
3,682,028 A * 8/1972 Clayton et al. ..... 83/660
3,719,736 A * 3/1973 Woodruff ..... 264/156
3,760,671 A * 9/1973 Jenkins ..... 83/660
3,965,906 A 6/1976 Karami
3,971,838 A 7/1976 Yazawa
4,886,632 A * 12/1989 Van Iten et al. ..... 425/290
5,372,494 A * 12/1994 Vaughan ..... 425/196
6,221,192 B1 4/2001 Walsh
6,488,801 B1 12/2002 Bodaghi et al.
6,739,024 B1 * 5/2004 Wagner ..... 28/106

(Continued)

FOREIGN PATENT DOCUMENTS

EP 0 214 608 A 3/1987

(Continued)

*Primary Examiner*—Amy B Vanatta
(74) *Attorney, Agent, or Firm*—Alston & Bird LLP

(57) ABSTRACT

The present invention relates to perforation device for the manufacture of a perforated nonwoven material, whereby a prebonded nonwoven with embossing points is guided to a nonwoven perforation device, needles of a needle roller engage into the prebonded nonwoven and perforate it, and the perforated nonwoven material then undergoes further processing. A ratio is set between the number of needles to the number of embossed points of between 0.15 and 0.25 and a ratio of hole size to embossed point size of between 0.15 and 0.25.

16 Claims, 2 Drawing Sheets

U.S. PATENT DOCUMENTS

| | | | | |
|---|---|---|---|---|
| 6,750,166 | B1 * | 6/2004 | Etzold et al. | 28/107 |
| 2003/0121380 | A1 * | 7/2003 | Cowell et al. | 83/660 |

FOREIGN PATENT DOCUMENTS

| | | | |
|---|---|---|---|
| EP | 1 046 479 | A | 10/2000 |
| EP | 1 048 419 | A | 11/2000 |
| WO | WO 99 67454 | A | 12/1999 |
| WO | WO 00 34562 | A | 6/2000 |

* cited by examiner

PERFORATION DEVICE

CROSS-REFERENCE TO RELATED APPLICATIONS

This application is a continuation of U.S. patent application Ser. No. 11/036,513, filed Jan. 14, 2005 now U.S. Pat. No. 7,192,392 which is a continuation of PCT/EP03/07216, filed Jul. 5, 2003, claiming priority from German Application No. 102 32 147.7, filed Jul. 16, 2002 which is hereby incorporated herein in its entirety by reference.

BACKGROUND OF THE INVENTION

The present invention relates to a nonwoven perforation device for manufacturing a perforated nonwoven and a perforated nonwoven material Perforating materials is part of the prior art if the intention is to provide specific properties in materials, such as permeability to liquid and/or vapor. For example, providing a top sheet of a material for a hygiene article with perforations is known from U.S. Pat. No. 3,965,906. For this purpose, a needle roller is used, which is positioned diametrically opposite a brush roller. Using this perforation device, a film or a nonwoven is perforated. The nonwoven or film is to absorb liquid and conduct it through when it is used as a top sheet in a hygiene article. A perforation device which has a needle roller and a perforated roller is known from European Patent Application 1 046 479 A1 and from European Patent Application 1 048 419. Nonwoven materials and films may be passed through between the needle roller and the perforated roller and perforated. Using this device, three-dimensional perforation holes are also to be achieved in particular.

The object of the present invention is to allow continuous perforation of approximately circular holes.

SUMMARY OF THE INVENTION

The present invention provides a perforation device which can be used for manufacturing a perforated nonwoven material, more particularly, a thermobonded nonwoven having embossed points. Needles of the needle roller of the nonwoven perforation device engage in the nonwoven and perforate the nonwoven. The nonwoven is subsequently processed further. This may occur either directly after the nonwoven perforation device or at a later time. For example, the nonwoven is wound up using a rewinder after the perforation. The surface of the nonwoven may also be treated. For example, one or more substances may be applied. The present invention provides that the ratio between a needle number of the needle roller and an embossed point number of the thermobonded nonwoven provided with embossed points is set between 0.15 and 0.25 and a ratio of a hole size in the perforated nonwoven to an embossed point size of the thermobonded nonwoven is set 15 between 0.15 and 0.25. A further improvement may be achieved if the ratio between perforation count and embossed point number is between 0.15 and 0.19. An additional improvement may also be observed if the ratio between hole size and embossed point size is between 0.15 and 0.19.

It has been shown that it is advantageous for achieving holes which are circular as possible in the perforated nonwoven if the corresponding perforation tool and the embossed points in the nonwoven are tailored to one another. Otherwise, the perforated holes may have notches or may be implemented as oval. In particular, it has been shown to be advantageous, for a predetermined embossed surface, to use a corresponding number of many small embossed figures, instead of manufacturing this embossed surface through a few large embossed figures and, in particular, embossing points. Experiments have shown that during a perforation step, smaller embossed figures may be displaced much more easily than large figures. In the following, the concept of embossed point is to be understood as all embossed figures which fall under the definition above. According to one embodiment, the embossed figures cover the entire surface without any intermediate space. According to another embodiment, the embossed figures are at least partially provided with an intermediate space, in the form of a ring, for example. Further embossed figures may be round, rhomboidal, oval, rectangular, and/or approximately star-shaped. Different embossed figures may also be used together.

Parameters of experimental rollers, using which different tests were performed, may be read from the following table. The rollers used were engraved rollers. The embossed figures may, however, also be applied to a matrix through spark erosion or other production methods, for example. The matrix does not absolutely have to be a roller. Instead of a roller, a strip or something similar may also be used.

| Roller | Figure shape in top view | Pressing area Dimension [mm] | Pressing area [$mm^2$] | Figures [number/$cm^2$] | Pressing area proportion [%] |
|---|---|---|---|---|---|
| Roller 1 | Circular | 0.541 | 0.208 | 69.86 | 14.49 |
| Roller 2 | Circular | 0.756 | 0.449 | 32.65 | 14.66 |
| Roller 3 | Oval | 0.834*<br>0.495 | 0.325 | 49.90 | 16.19 |

It has been shown to be advantageous if a pressing area of an embossed figure is in a range between 0.15 $mm^2$ and 0.4 $mm^2$, preferably in a range between 0.18 $mm^2$ and 0.35 $mm^2$. The number of embossed figures is to be between 43 per $cm^2$ and 80 per $cm^2$. A pressing area proportion on a roller is preferably between 10% and 18%, for example.

It is advantageous if a nonwoven is used which has an embossed point count between 55 points/$cm^2$ and 80 points/$cm^2$. An appropriately thermally treated nonwoven may be provided from an unwinder. Another embodiment provides that the nonwoven is guided directly from a nonwoven production device to a thermobonding device. Subsequently, the thermally bonded nonwoven having the desired embossed point count and embossed point size is guided to the nonwoven perforation device. Between 10 perforation/$cm^2$ and 20 perforation/$cm^2$ are preferably produced in the nonwoven. Particularly in the field of hygiene applications, this number of perforations has been shown to be advantageous for absorbing the liquids which encounter the nonwoven. For hygiene applications, the perforated nonwoven is used as a top sheet, for example. Further fields of application are the household field, for example, top sheets in dishcloths, the medical sector, for cover sheets, for example, for protective clothing, and other fields. Furthermore, the nonwoven may be used in filtration applications, in construction, and/or in laminates with other materials. These may be fabrics, films made of metal or thermoplastic material, and even rigid surfaces, paper, paperboard, or even nets.

Dimensions of a needle roller, using which exemplary experiments were performed, are listed in the following table.

| Roller | Needle shape in top view | Needle diameter [mm] | Needle area [$mm^2$] | Needles [number/$cm^2$] | Needle area proportion [%] |
|---|---|---|---|---|---|
| Needle roller | Circular | 1.95 | 2.987 | 15.36 | 45.86 |

An insertion depth of the needles was preferably between 2 mm and 4.5 mm, particularly between 2.5 mm and 3 mm, for example. The insertion depth of the needles is particularly a function of the nonwoven thickness. Preferably, particularly for the hygiene field, nonwoven weights between 14 gsm and 50 gsm are used. In other fields, nonwoven weights of more than 50 gsm may be used, particularly in construction, for textiles, and for geotextiles.

A preferred hole size in the nonwoven is between 0.8 $mm^2$ and 1.8 $mm^2$. Furthermore, a perforated nonwoven which has embossed points caused by thermobonding has a ratio of a perforation count to an embossed point count between 0.15 and 0.25 and a ratio of a hole size to an embossed point size between 0.15 and 0.25. A further improvement may be achieved if the ratio between perforation count and embossed point count is between 0.15 and 0.19. An additional improvement may also be observed if the ratio between hole size and embossed point size is between 0.15 and 0.19.

The following table reproduces exemplary data of a perforated nonwoven. This is data which was obtained from a single-layer 15 spunbonded nonwoven having an area weight of 30 gsm.

| | | |
|---|---|---|
| Hole dimensions | Area [$mm^2$] | 1.16 |
| | Diameter MD [mm] | 1.33 |
| | Diameter CD [mm] | 1.11 |
| | Axis ratio MD/CD | 1.2 |
| Open area | [%] | 18.7 |
| Thickness | [mm] | 0.709 |
| Tensile strength | MD [n/50 mm] | 26.63 |
| | CD [N/50 mm] | 23.52 |
| Extension | At rupture MD [%] | 21.93 |
| | At rupture CD [%] | 30.14 |

MD: machine direction
CD: cross direction

Different strength properties may be influenced through different variables. These variables may be the number of perforations, the number of bonding embossings in the nonwoven, their size, and also other parameters.

The corresponding parameters are preferably to be set in such a way that the nonwoven has a strength in MD which is greater than a strength in CD. In particular, the nonwoven has a minimum strength of 6 N/50 mm in CD and 8 N/50 mm in MD. Preferably, particularly in hygiene applications if the nonwoven is used as a top sheet, for example, the nonwoven has a strength which is at least 20 N/50 mm in both directions.

The nonwoven used may be single layer or multilayer. It may have one or more polymers. Usable polymers are particularly polypropylene, polyethylene, polyamide, polyester, etc. The nonwoven may be a spunbonded nonwoven, a meltblown, a staple fiber nonwoven, or something different. The fibers of the nonwoven may be multicomponent fibers.

According to a further idea of the present invention, a perforated nonwoven is provided which has embossed points produced by thermobonding. The perforations have crater-like perforation edges in the nonwoven, which arise from the nonwoven. A longest axis of an embossed point in the nonwoven is smaller than a height of a perforation edge of a perforation in the nonwoven. In particular, the perforation edge to be considered is positioned neighboring the embossed point whose longest axis is considered in the ratio to the height of the perforation edge. It has been shown that with this type of selection of a ratio between three-dimensionality and the perforation and thermal bonding of the nonwoven, an especially large uniformity of round perforations may be observed, which may be produced continuously.

A further idea of the present invention provides that a nonwoven perforation device is provided for performing a method described above and/or for manufacturing a nonwoven described above. The nonwoven perforation device has at least one needle roller and a counter roller. The needle roller and the counter roller form a gap. A nonwoven is guided through the gap for perforation. The needle roller has a needle count between 10 needles/$cm^2$ and 25 needles/$cm^2$. At least some of the needles have a circular diameter. An effective needle diameter is between 1.5 mm and 2.5 mm. A needle area component of the surface of the needle roller is between 35% and 65%. The effective needle diameter is the diameter which generates the perforations in connection with the nonwoven and is responsible for their size.

Advantageous features and embodiments arise from the following drawing. The features illustrated therein do not restrict the present invention as such, however, but rather may be combine with the features already described into further refinements of the present invention, not described here in greater detail.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present inventions now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
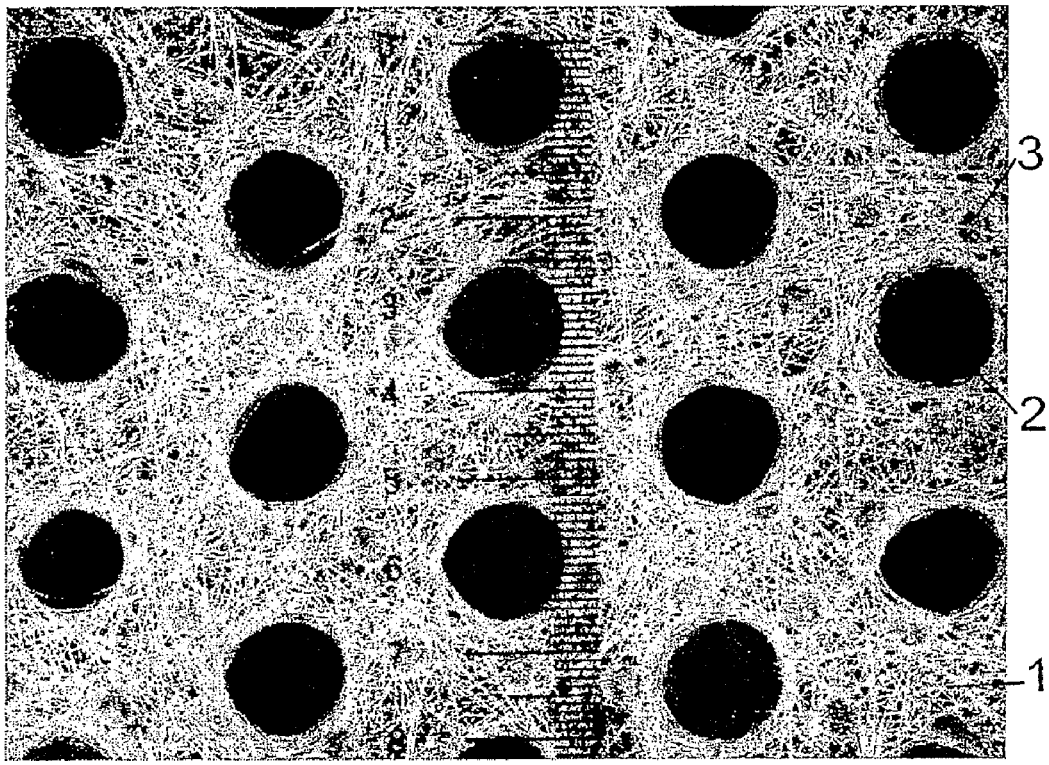
FIG. 1 shows a first perforated nonwoven.

FIG. 1 shows an example of a perforated nonwoven 1. The nonwoven is single-layer and has an area weight of 30 gsm. The nonwoven is a spunbonded nonwoven, which has been produced according to the Dokan method. A standard polypropylene was used as the thermoplastic material. The nonwoven is illustrated here in a top view, black cardboard being used as an underlay. Furthermore, this view is in a scale which shows dimensions in mm. The zoom factor used here is 1.5. Beside the perforations 2, which may be seen as black holes, there are embossed points 3. The embossed points 3 are much smaller than the perforations 2. The perforations 2 are preferably larger than the embossed points 3 by at least a factor of 4.

Figure 2:
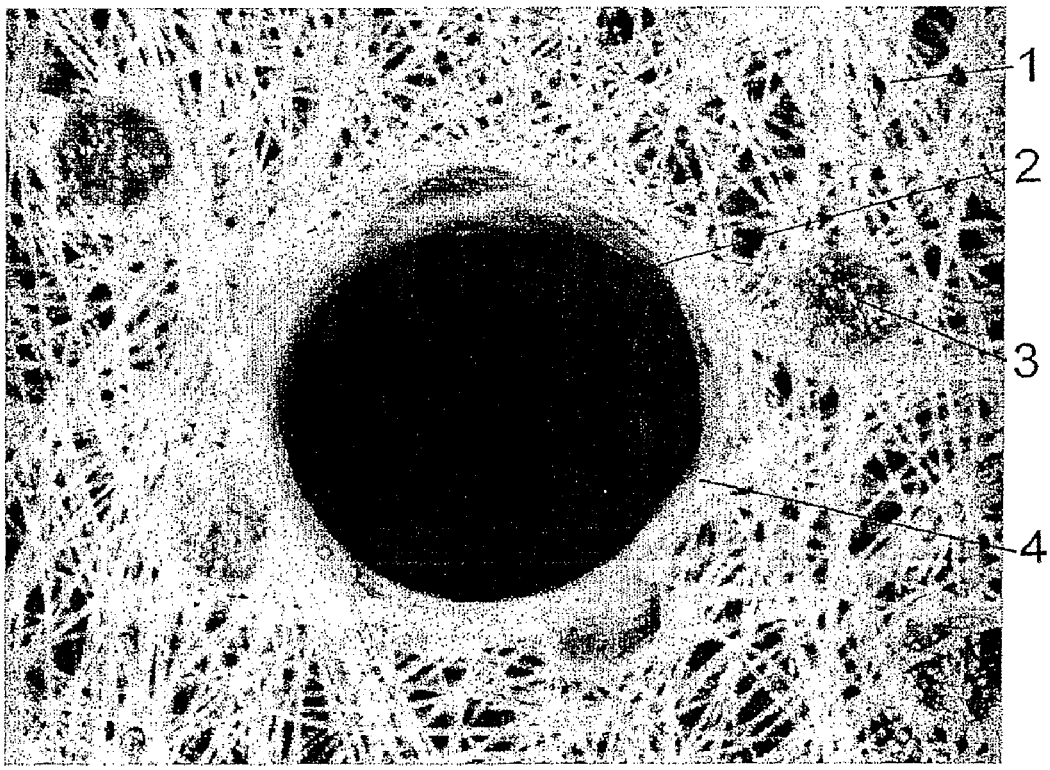
FIG. 2 shows a close-up of a perforation.

FIG. 2 shows an enlargement of FIG. 1. The perforated nonwoven 1 is illustrated with a perforation 2 and the surrounding embossed points 3. It may be seen that fibers of the nonwoven 1 are displaced by the perforation procedure and form a perforation edge 4. The fiber structures are preferably maintained in this case. The fibers have not been melted. A further embodiment provides that the fibers are heated to the softening temperature, so that neighboring fibers adhere to one another on their surface. Embossed points 3 are also partially included in this perforation edge 4. Although these embossed points cause a certain rigidity and strength in the nonwoven, the embossed point size is tailored in such a way that perforation still leads to approximately circular holes. If the embossed point size is too large in relation to the size of the perforation 2, there is the danger that the holes will have notches. Instead of circular perforations 2, oval holes or holes having another shape could also arise. It has been shown to be especially advantageous if a longest axis of an embossed point is smaller than a height of a perforation edge 4, which arises through deformation of the nonwoven during the perforation. The relatively strong embossed point is otherwise deformed through the deformation of the nonwoven in such a way that indentations arise at the edge of the perforation hole.

Figure 3:
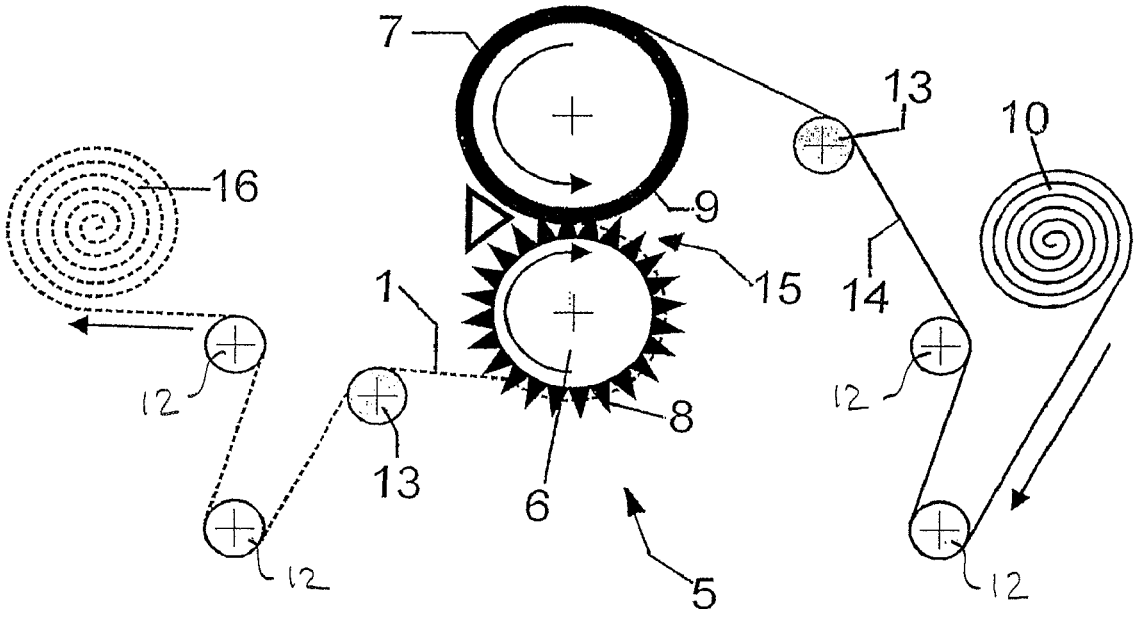
FIG. 3 shows a nonwoven perforation device in a schematic view.

FIG. 3 shows a nonwoven perforation device 5 having a needle roller 6 and a counter roller 7. Needles 8 are positioned on the needle roller 6. The needles 8 engage in the surface 9 of the counter roller 7. The surface 9 is preferably yielding to the needles 8. In particular, the surface 9 may have a felt material. Furthermore, the nonwoven perforation device 5 has an unwinder 10. A prebonded nonwoven 14, which is provided with embossed points, is guided from the unwinder 10 to the counter roller 7 via rolls 12. The rolls 12 preferably include a tension measuring roll 13. The tension measuring roll allows a tensile force, which acts on the nonwoven 14 to be perforated, to be checked. The tensile force may, for example, be set via the rolls 12 and via the tension measuring roll 13, particularly also in interaction with the counter roller 7 and the unwinder 10. From the tension measuring roll 13, the nonwoven 14 to be perforated is guided to the counter roller 7 and loops around it for a specific range. This range is preferably greater than 45 degrees. In this range, while in contact with the counter roller 7, the nonwoven may be heated, for example. In particular, there is the possibility of heating the nonwoven to a temperature which lies below the melting temperature of the polymer used or the polymers from which the nonwoven was produced. Furthermore, the nonwoven may also be heated up to a limit of the softening temperature of the thermoplastic material. From the counter roller 7, the nonwoven 14 to be perforated is guided into a gap 15. The gap 15 is formed by the needle roller 6 and the counter roller 7. In the gap 15, the nonwoven 14 to be perforated is perforated by the needles 8. In this case, the needles 8 are engaged with the surface 9 of the counter roller 7. According to this embodiment of the nonwoven perforation device 5, this perforated nonwoven is preferably guided from the counter roller 7 to the needle roller 6. The nonwoven preferably remains on the needle roller 6 for a certain looping range. The looping range is preferably greater than 45 degrees, in particular, it is in a range between 90 degrees and 270 degrees. Keeping the perforated nonwoven 1 on the needle roller 6 particularly leads to stabilization of perforation edges. Instead of looping of the needle roller 6, the perforated nonwoven may also be guided to a winder 16 after the gap 15. Rolls 12 are preferably again positioned between the needle roller 6 and the winder 16. One of the rolls 12 is preferably a tension measuring roll 13. The perforated nonwoven 1 coming from the needle roller 6 may again be wound into a roll on the winder 16 at an adjustable defined tension in this way.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed is:

1. A perforation device for perforating a nonwoven material, comprising at least one needle roller and a counter-roller having a peripheral surface, wherein the needle roller and the counter-roller from a gap through which a nonwoven material is conducted for the purpose of perforation, wherein the needle roller has a number of needles of between 10 needles/$cm^2$ and 25 needles/$cm^2$, and wherein the needles have at least in part a circular diameter, have an effective needle diameter of between 1.5 mm and 2.5 mm, and a needle area component of the surface of the needle roller of between 35% and 65%.

2. The perforation device of claim 1, wherein the needle roller and the counter-roller are mounted so that the needles of the needle roller engage the peripheral surface of the counter-roller.

3. The perforation device of claim 2, wherein the peripheral surface of the counter-roller is made of a material that yields to the needles.

4. The perforation device of claim 3, wherein the peripheral surface comprises a felt material.

5. The perforation device of claim 1, additionally including an unwinder positioned adjacent the needle roller and counter-roller for receiving a roll of nonwoven material.

6. The perforation device of claim 5, including rolls positioned adjacent the unwinder and said rollers for guiding the nonwoven material from the unwinder to said rollers.

7. The perforation device of claim 6, wherein said rolls include a tension measuring roll positioned for engaging the nonwoven material in its path of travel from the unwinder to said rollers and operable for measuring tension.

8. The perforation device of claim 7, additionally including guide rolls positioned between the unwinder and said rollers for guiding the nonwoven material in its path of travel.

9. The perforation device of claim 6, wherein said rolls are oriented for directing the nonwoven material onto the peripheral surface of the counter-roller and partially around the counter roller before the nonwoven material enters said gap between the needle roller and the counter-roller.

10. The perforation device of claim 9, wherein the nonwoven material loops around the counter-roller through an arc greater than 45 degrees.

11. The perforation device of claim 1, including rolls adjacent the needle roller and oriented for directing the nonwoven material to remain on the needle roller for a certain looping range after emerging from said gap.

12. The perforation device of claim 11, wherein the rolls are oriented so that the nonwoven material remains on the needle roller through an arc of greater than 45 degrees.

13. The perforation device of claim 12, wherein the rolls are oriented so that the nonwoven material remains on the needle roller through a range of 90 to 270 degrees.

14. The perforation device of claim 11, wherein the rolls include a tension measuring roll.

15. The perforation device of claim 14, wherein the rolls additionally include at least one guide roll.

16. The perforation device of claim 15 including a winder for receiving the perforated nonwoven material from said at least one guide roll and for winding the material into the form of a roll.

* * * * *